US011713536B2

(12) United States Patent
Mora et al.

(10) Patent No.: US 11,713,536 B2
(45) Date of Patent: Aug. 1, 2023

(54) WASHING MACHINE LID WITH COMPOUND PIVOT AXIS

(71) Applicant: Haier US Appliance Solutions, Inc., Wilmington, DE (US)

(72) Inventors: Adam Raymond Mora, La Grange, KY (US); Venkata Chakradhar Rangu, Hyderabad (IN); Neelapala Gopinath Yadav, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 161 days.

(21) Appl. No.: 17/154,651

(22) Filed: Jan. 21, 2021

(65) Prior Publication Data

US 2022/0228311 A1 Jul. 21, 2022

(51) Int. Cl.

| | |
|---|---|
| ***D06F 39/14*** | (2006.01) |
| ***D06F 23/04*** | (2006.01) |
| ***E05D 3/12*** | (2006.01) |
| *E05F 3/20* | (2006.01) |
| *E05F 3/04* | (2006.01) |
| *E05F 1/12* | (2006.01) |

(52) U.S. Cl.

CPC ..... *D06F 39/14* (2013.01); *D06F 23/04* (2013.01); *E05D 3/122* (2013.01); *E05F 1/12* (2013.01); *E05F 3/04* (2013.01); *E05F 3/20* (2013.01); *E05Y 2900/312* (2013.01)

(58) Field of Classification Search

CPC ..... D06F 39/14; D06F 23/04; E05D 3/122; E05F 1/12; E05F 3/04; E05F 3/20; E05Y 2900/312

USPC ..... 68/212

See application file for complete search history.

(56) References Cited

U.S. PATENT DOCUMENTS

| | | | | |
|---|---|---|---|---|
| 8,444,234 | B2 | 5/2013 | Kim et al. | |
| 2011/0131886 | A1* | 6/2011 | Durr | A47L 15/4261 49/386 |

FOREIGN PATENT DOCUMENTS

| | | | |
|---|---|---|---|
| CN | 208104807 | U | 11/2018 |
| KR | 2015/0136291 | A | 12/2015 |
| WO | WO2019/124872 | A1 | 6/2019 |

OTHER PUBLICATIONS

KR20150136291A—machine translation (Year: 2015).*
WO2019124872A1—machine translation (Year: 2019).*

* cited by examiner

*Primary Examiner* — Tinsae B Ayalew
(74) *Attorney, Agent, or Firm* — Dority & Manning, P.A.

(57) ABSTRACT

A washing machine includes a cabinet defining a lateral direction, a transverse direction, and a vertical direction. The lateral, transverse, and vertical directions are mutually orthogonal. The washing machine appliance also includes a top panel on the cabinet that defines an opening. A wash chamber is defined within the cabinet below the opening of the top panel. The washing machine appliance also includes a lid which is rotatable through a plane defined by the transverse direction and the vertical direction between a closed position to sealingly enclose the wash chamber and an open position to permit access to the wash chamber. A hinge rotatably connects the lid to the top panel. The hinge defines a compound pivot axis. The lid rotates relative to the top panel about the compound pivot axis.

10 Claims, 6 Drawing Sheets

WASHING MACHINE LID WITH COMPOUND PIVOT AXIS

FIELD OF THE INVENTION

The present subject matter relates generally to washing machines, and more particularly to lids and fastening mechanisms therefor.

BACKGROUND OF THE INVENTION

Washing machines typically include a cabinet with a wash tub defined therein. Further, a wash basket is commonly provided within the wash tub. Washing machine appliances commonly utilize wash and rinse fluids to clean clothing articles disposed within the wash baskets. The wash tub contains the fluids within the cabinet of the washing machine. However, it is necessary to access the wash basket, e.g., to add or remove articles. Thus, the cabinet typically includes an opening and a lid or door attached to the cabinet to selectively rotate between a closed position and an open position which provides such access to the wash basket.

Typically, the lid or door is attached to the washing machine with conventional mechanical fasteners, e.g., screws or bolts. Use of such known attachment mechanisms does not permit the force, e.g., torque, required to open the lid to be effectively damped and provides little, if any, ability to control the opening force. Additionally, the clearance between the lid and the cabinet is typically quite small, providing limited physical space in which to direct or distribute the opening force.

Accordingly, a washing machine with improved features for rotatably connecting a lid thereof to a cabinet of the washing machine would be useful.

BRIEF DESCRIPTION OF THE INVENTION

Aspects and advantages of the invention will be set forth in part in the following description, or may be apparent from the description, or may be learned through practice of the invention.

In a first exemplary embodiment, a washing machine appliance is provided. The washing machine appliance includes a cabinet. The cabinet defines a lateral direction, a transverse direction, and a vertical direction. The lateral, transverse, and vertical directions are mutually orthogonal. A top panel on the cabinet defines an opening. A wash chamber is defined within the cabinet below the opening of the top panel. The washing machine appliance also includes a lid which is rotatable through a plane defined by the transverse direction and the vertical direction between a closed position to sealingly enclose the wash chamber and an open position to permit access to the wash chamber. A hinge rotatably connects the lid to the top panel. The hinge defines a lid pivot axis and a hinge pivot axis offset from the lid pivot axis. The lid rotates relative to the hinge about the lid pivot axis and a portion of the hinge rotates relative to the top panel about the hinge pivot axis.

In a second exemplary embodiment, a washing machine appliance is provided. The washing machine appliance includes a cabinet defining a lateral direction, a transverse direction, and a vertical direction. The lateral, transverse, and vertical directions are mutually orthogonal. The washing machine appliance also includes a top panel on the cabinet that defines an opening. A wash chamber is defined within the cabinet below the opening of the top panel. The washing machine appliance also includes a lid which is rotatable through a plane defined by the transverse direction and the vertical direction between a closed position to sealingly enclose the wash chamber and an open position to permit access to the wash chamber. A hinge rotatably connects the lid to the top panel. The hinge defines a compound pivot axis. The lid rotates relative to the top panel about the compound pivot axis.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
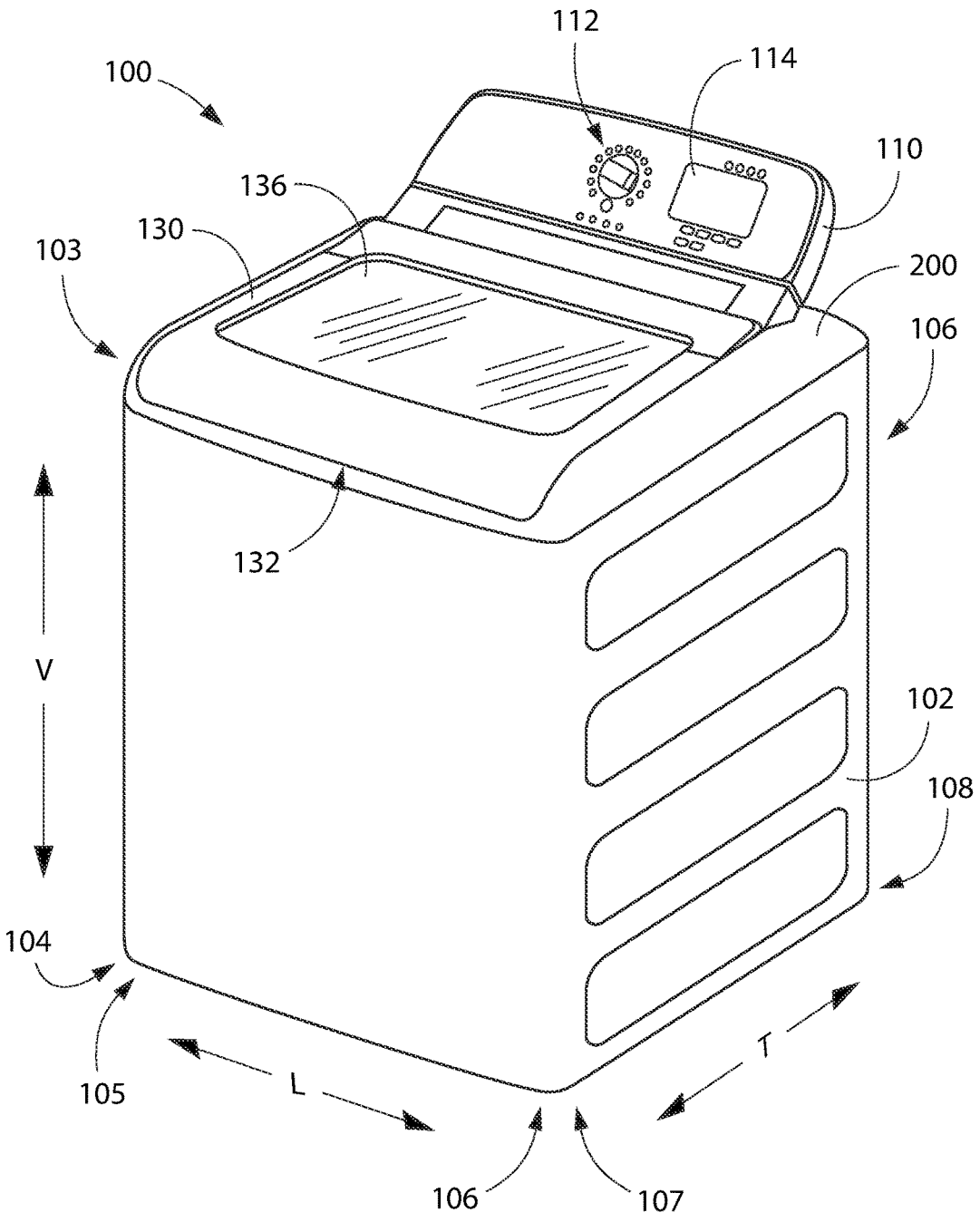
FIG. 1 provides a perspective view of a washing machine appliance according to an exemplary embodiment of the present subject matter with a lid of the exemplary washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
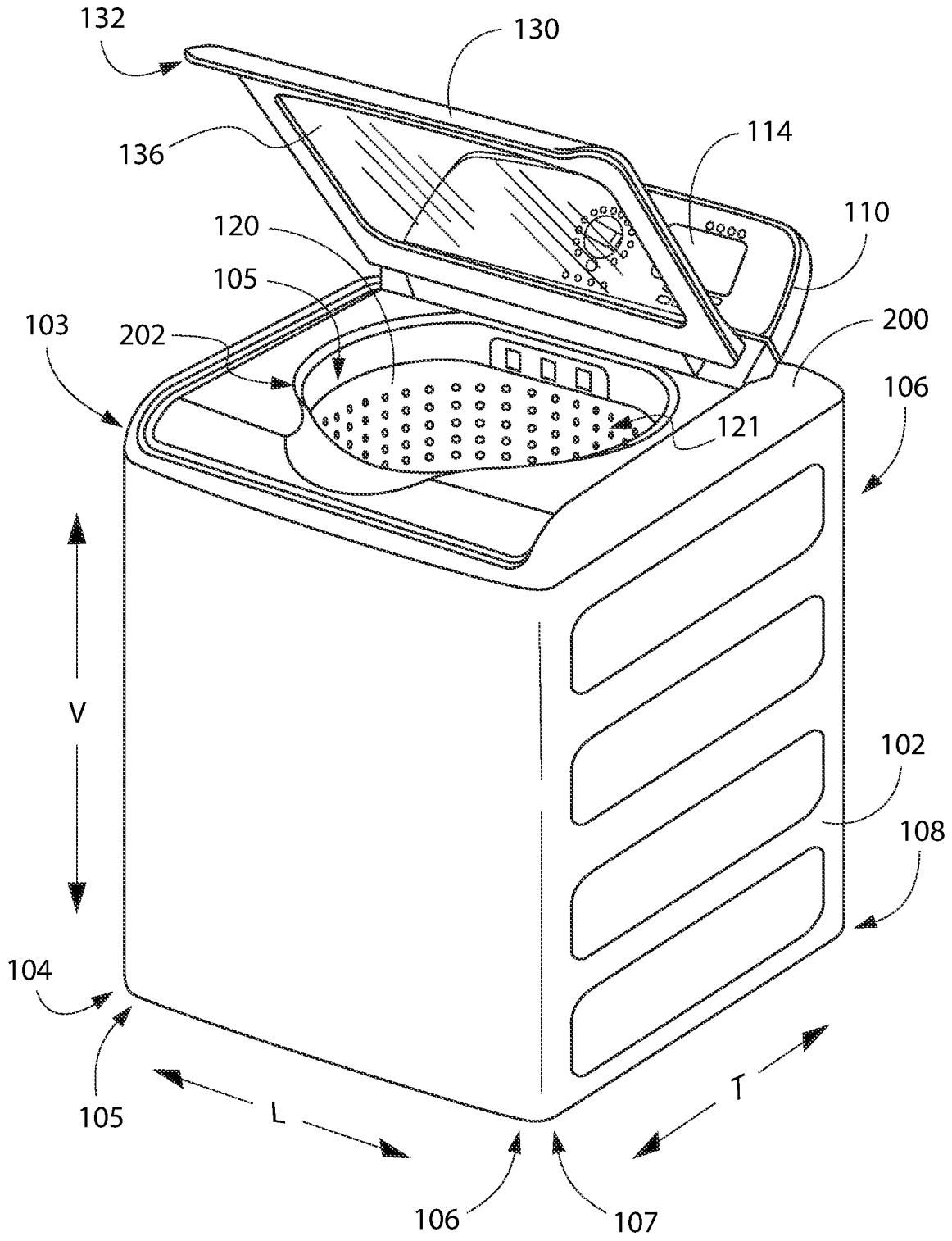
FIG. 2 provides a perspective view of the exemplary washing machine appliance of FIG. 1 with the lid shown in an open position.

FIGS. 1 and 2 illustrate an exemplary embodiment of a vertical axis washing machine appliance 100. In FIG. 1, a lid or door 130 (collectively referred to hereinafter as a "lid") is shown in a closed position. In FIG. 2, lid 130 is shown in an open position, e.g., a partially open position wherein the lid 130 is spaced apart from the top panel 200 to permit access to the wash chamber 121 but the lid 130 has not travelled to the fullest extent of its rotational path of travel. While described in the context of a specific embodiment of vertical axis washing machine appliance 100, it will be understood that vertical axis washing machine appliance 100 is provided by way of example only. Other washing machine appliances having different configurations, different appearances, and/or different features, e.g., horizontal axis washing machines, may also be utilized with the present subject matter as well.

As may be seen in FIGS. 1 and 2, washing machine appliance 100 defines a vertical direction V, a lateral direction L and a transverse direction T. The vertical direction V, lateral direction L and transverse direction T are mutually perpendicular and form an orthogonal direction system. Washing machine appliance 100 has a cabinet 102 that extends between a top portion 103 and a bottom portion 104 along the vertical direction V. Cabinet 102 also extends between a first side portion 105 and a second side portion 106, e.g., along the lateral direction L, and a front portion 107 and a back portion 108, e.g., along the transverse direction T.

A wash basket 120 is rotatably mounted within cabinet 102, e.g., within a wash tub (not shown) disposed within cabinet 102. A motor (not shown) is in mechanical communication with wash basket 120 in order to selectively rotate wash basket 120, e.g., during an agitation or a rinse cycle of washing machine appliance 100. Wash basket 120 defines a wash chamber 121 that is configured for receipt of articles for washing. An agitator or impeller (not shown) extends from wash basket 120 into wash chamber 121. The impeller assists agitation of articles disposed within wash chamber 121 during operation of washing machine appliance 100. Additionally, in some embodiments, the motor (not shown) may be coupled to the impeller as well as or instead of the wash basket 120 to provide relative rotation between the impeller and the wash basket 120.

Figure 5:
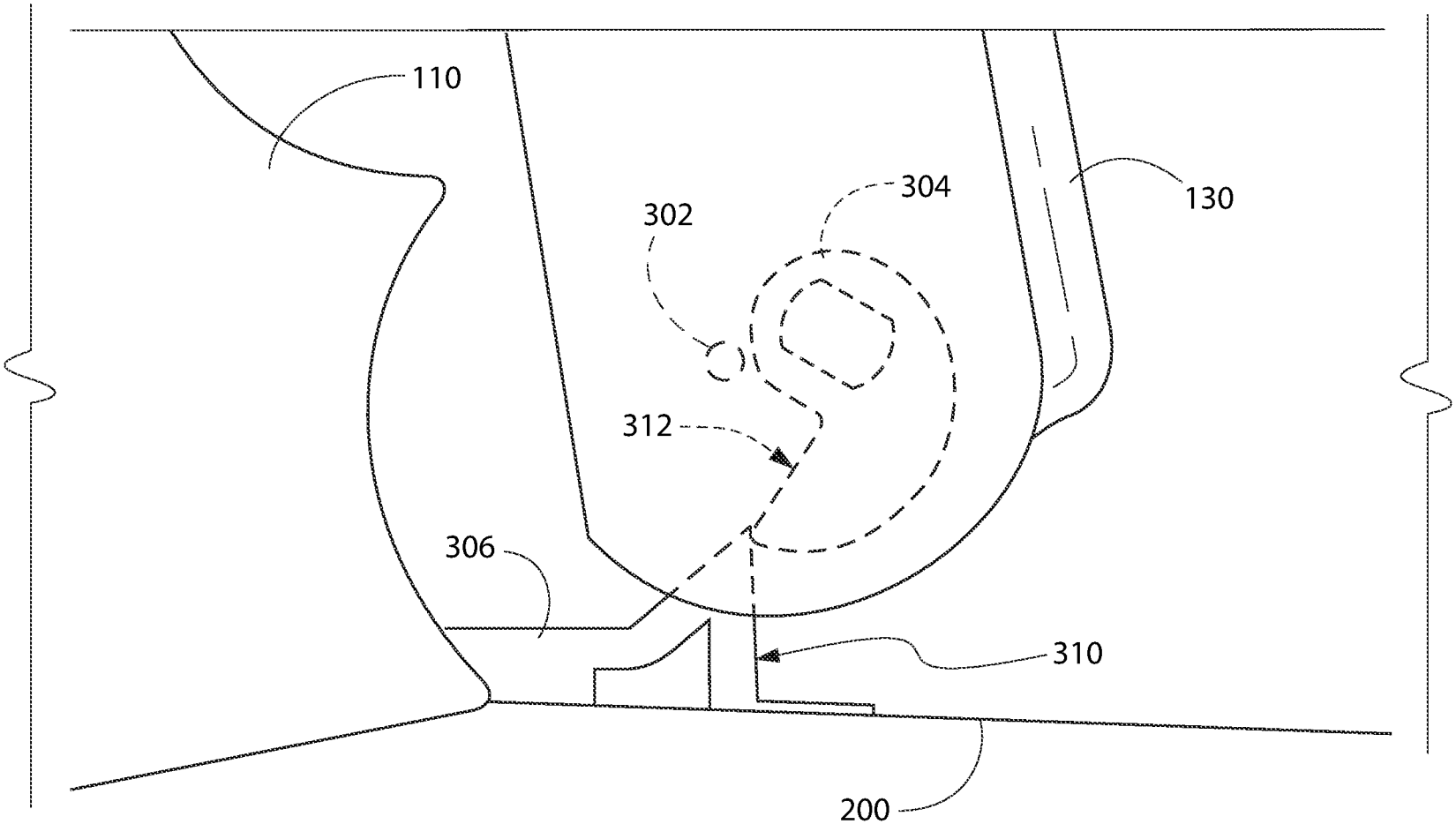
FIG. 5 provides a side view of the hinge and lid of FIG. 3 in a fully open position.

In some exemplary embodiments, e.g., as illustrated in FIGS. 1 and 2, cabinet 102 of washing machine appliance 100 has a top panel 200 positioned at or adjacent top portion 103 of cabinet 102. Top panel 200 defines an opening 202 that permits user access to wash chamber 121 of wash basket 120. Lid 130 is rotatably mounted to top panel 200. However, alternatively, lid 130 may be mounted to cabinet 102 or any other suitable support. Lid 130 selectively rotates between the closed position shown in FIG. 1 and the open position shown in FIG. 2, and further to the fully open position as shown in FIG. 5 and described in more detail below. In the closed position, lid 130 inhibits access to wash chamber 121. Conversely, in the fully or partially open position, a user can access wash chamber 121. An aperture 136 in lid 130 permits viewing of wash chamber 121 when lid 130 is in the closed position, e.g., during operation of washing machine appliance 100. Lid 130 also includes a handle 132 that, e.g., a user may pull and/or lift when opening and closing lid 130.

A control panel 110 with a plurality of input selectors 112 extends from top panel 200 at top portion 103 of cabinet 102. Control panel 110 and input selectors 112 collectively form a user interface input for operator selection of machine cycles and features. A display 114 of control panel 110 indicates selected features, a countdown timer, and/or other items of interest to appliance users.

Operation of washing machine appliance 100 is controlled by a controller or processing device (not shown) that is operatively coupled to control panel 110 for user manipulation to select washing machine cycles and features. In response to user manipulation of control panel 110, the controller operates the various components of washing machine appliance 100 to execute selected machine cycles and features.

Suitable controllers for use in washing machine appliance 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. The processor may execute programming instructions stored in memory. The memory may be a separate component from the processor or may be included onboard within the processor. Alternatively, a suitable controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with the controller via one or more signal lines or shared communication busses.

In an illustrative embodiment, laundry items are loaded into wash chamber 121 through opening 202 (with lid 130 in an open position), and washing operation is initiated (after rotating lid 130 to the closed position) through operator manipulation of input selectors 112. Wash basket 120 and/or the wash tub is filled with water and detergent to form a wash fluid. One or more valves (not shown) can be controlled by washing machine appliance 100 to provide for filling wash basket 120 to the appropriate level for the amount of articles being washed. Once wash basket 120 is properly filled with fluid, the contents of wash chamber 121 are agitated (e.g., with the impeller) for cleansing of laundry items in wash basket 120.

After the agitation phase of the wash cycle is completed, wash basket 120 is drained. Laundry articles can then be rinsed by again adding fluid to wash basket 120, and, depending on the particulars of the cleaning cycle selected by a user, the impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. Such high-speed rotation may cause vibration and/or relative movement between lid 130 and top panel 200, as such, hinge 300 (FIG. 3) must be sufficiently robust to provide a sturdy and reliable connection between lid 130 and top panel 200. After articles disposed in wash basket 120 are cleaned and/or washed, the user can remove the articles from wash basket 120, e.g., by rotating lid 130 to an open position using handle 132 and reaching into wash chamber 121 through opening 202.

Figure 3:
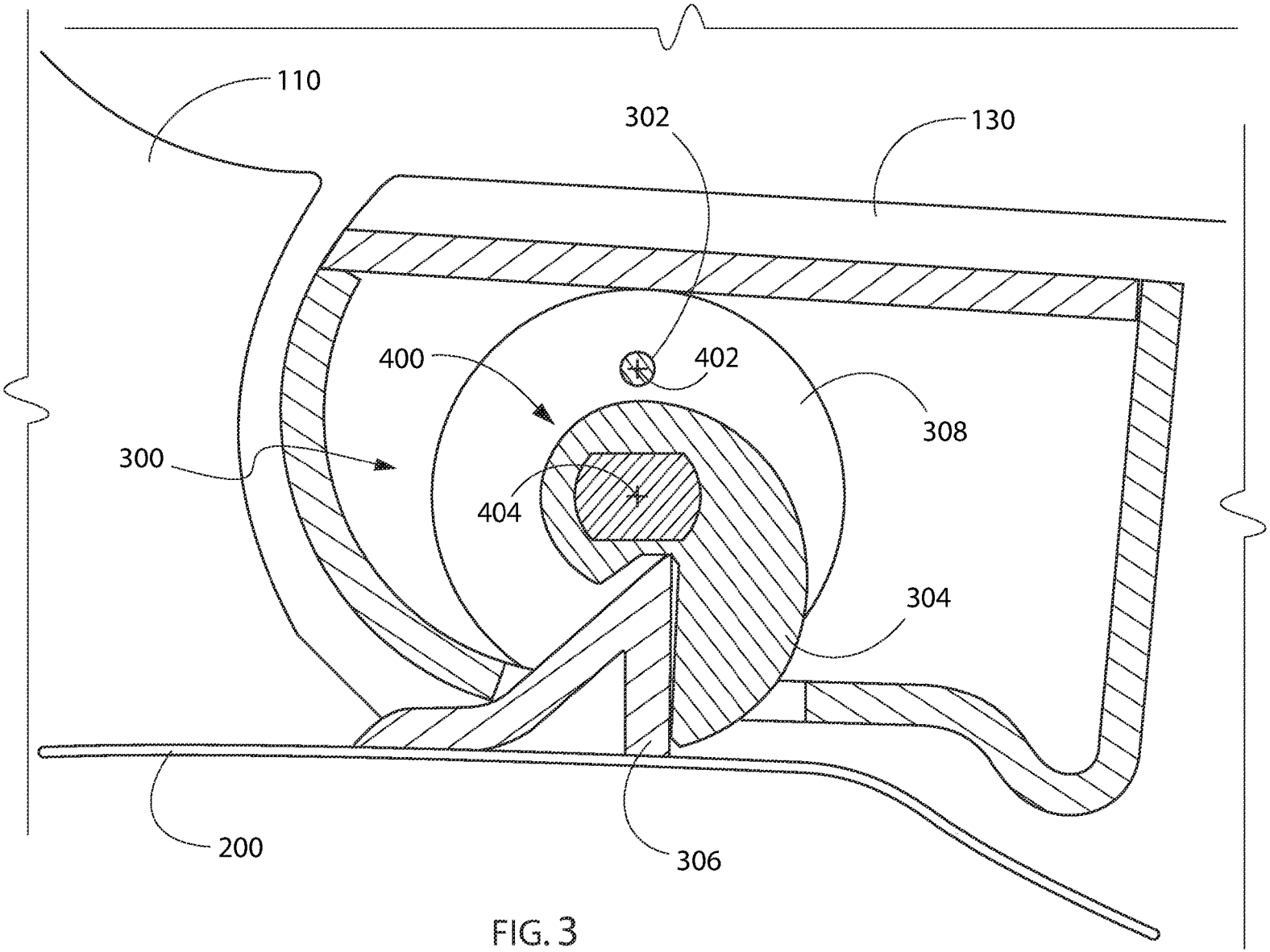
FIG. 3 provides a section view of a portion of a hinge and lid according to an exemplary embodiment of the present subject matter.

Referring now to FIG. 3, in some exemplary embodiments, hinge 300 includes a pin 302, a cam 304, and a stanchion 306. The cam 304 may be mounted to a housing 308. In some embodiments, the housing 308 may be hollow and a reservoir may be defined therein, such as for a damping fluid, e.g., the housing 308 may be or include a hydraulic damper to provide a soft close feature as will be generally understood by those of ordinary skill in the art. In additional embodiments, the housing 308 may include a biasing element, e.g., a spring such as a coil spring which is well understood by those of ordinary skill in the art, enclosed therein, and the cam 304 may be coupled to the biasing element, e.g., spring, enclosed within the housing 308. The hinge 300 may thereby define a compound pivot axis 400. For example, the compound pivot axis 400 may include a lid pivot axis 402 and a hinge pivot axis 404. In FIG. 3, the axes 402 and 404 extend perpendicular to the page. The lid pivot axis 402 may be defined by the pin 302.

Figure 4:
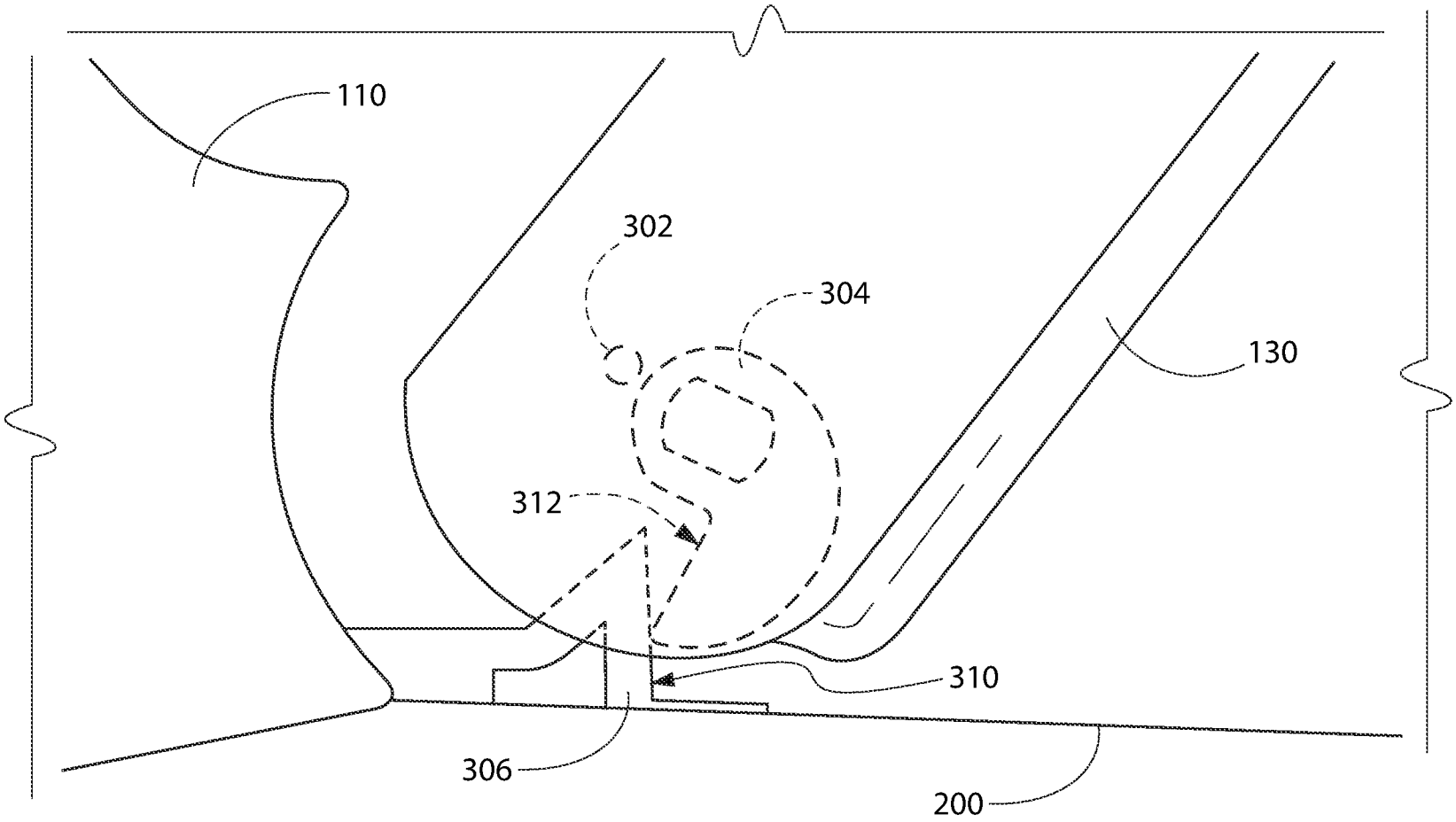
FIG. 4 provides a side view of the hinge and lid of FIG. 3 in a partially open position.

The hinge pivot axis 404 may be defined by the cam 304. As may be seen, e.g., in FIG. 3, the hinge pivot axis 402 is offset from the lid pivot axis 404, e.g., along the vertical direction V. As may be seen in FIGS. 3 through 5, as the lid 130 rotates between the closed position (FIG. 3), a partially open position (FIG. 4), and the fully open position (FIG. 5), the lid 130 rotates relative to the top panel 200 about the lid pivot axis 402 and a portion of the hinge 300, e.g., the cam 304 in the exemplary embodiment illustrated in FIGS. 3 through 5, rotates relative to the top panel 200 about the hinge pivot axis 404. The views in FIGS. 3 through 5 are taken in a plane defined by the vertical direction V and the transverse direction T, as is the view in FIG. 6 as well. Thus, the lid 130 rotates through a plane defined by the transverse direction T and the vertical direction V as the lid 130 travels between the closed position and the fully open position.

In some embodiments, e.g., as noted in FIGS. 4 and 5, the stanchion 306 may include a bearing surface 310. In such embodiments, the cam 304, such as a corresponding bearing surface 312 thereof, bears against the bearing surface 310 on the stanchion 306 throughout the range of motion of the lid 130 from the closed position (FIG. 3) to the fully open position (FIG. 5).

Figure 6:
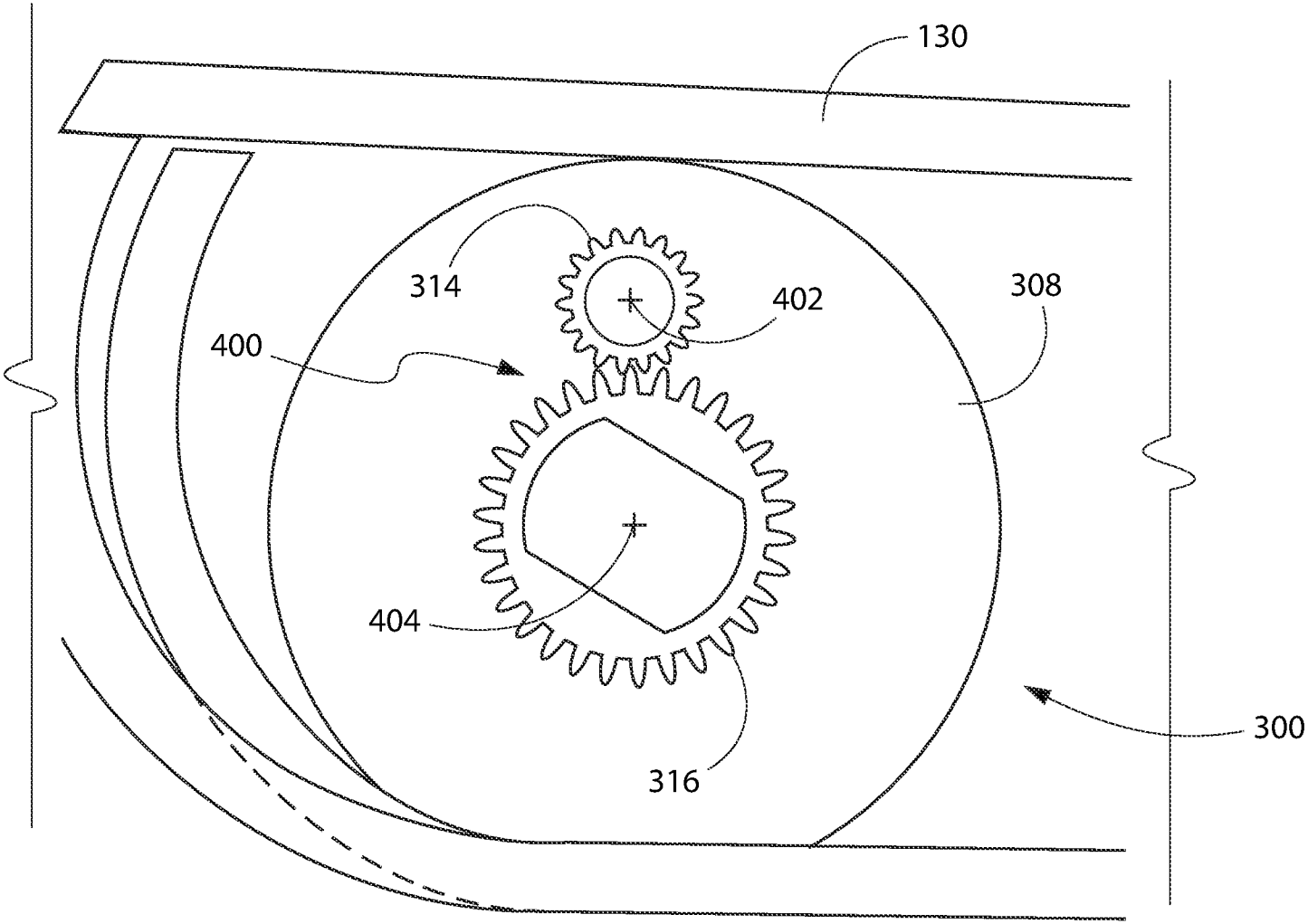
FIG. 6 provides a view of a hinge and a portion of a lid according to one or more additional exemplary embodiments of the present subject matter which may be incorporated into a washing machine appliance such as the exemplary washing machine appliance of FIGS. 1 and 2.

Turning now to FIG. 6, in some embodiments, the hinge 300 may include a pinion gear 314 and a drive gear 316. The drive gear 316 may be a fixed gear. In such embodiments, the lid pivot axis 402 may be defined by the pinion gear 314 and the hinge pivot axis 404 may be defined by the drive gear 316. Thus, in such embodiments, the lid 130 rotates relative to the top panel 200 about the pinion gear 314 and the lid pivot axis 402 defined thereby, while a portion of the hinge 300, e.g., the pinion gear 314, rotates relative to the top panel 200 about the hinge pivot axis 404. For example, the pinion gear 214 may engage with and revolve around the drive gear 316 as the lid 130 rotates between the closed position and the fully open position.

In various embodiments, the hinge 300 may include a torque transfer mechanism, e.g., hydraulic damper or spring. The structure and function of hydraulic dampers and springs are well understood by those of ordinary skill in the art and, as such, are not specifically illustrated or described in greater detail herein for the sake of brevity and clarity. The torque transfer mechanism may be positioned within the housing 308. In embodiments where the torque transfer mechanism is or includes a spring, the spring may be a torsion spring or a compression spring.

In various embodiments, the range of motion of the lid 130 may encompass an angular displacement of greater than about one hundred three degrees (103°), such as about one hundred fifteen degrees (115°) or more, such as about one hundred twenty-five degrees (125°) or more, such as about one hundred forty degrees (140°), between the closed position and the fully open position. Such angular displacement may advantageously provide increased fidelity, e.g., increased tunability of the required rotational force to open the lid 130. For example, such angular displacement may permit more precise control in designing the hinge 300 of the required opening and/or closing force of the lid 130.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet defining a lateral direction, a transverse direction, and a vertical direction, the lateral, transverse, and vertical directions are mutually orthogonal;

a top panel on the cabinet that defines an opening;

a stanchion mounted to the top panel, the stanchion comprising a bearing surface;

a wash chamber within the cabinet below the opening of the top panel;

a lid rotatable through a plane defined by the transverse direction and the vertical direction between a closed position to sealingly enclose the wash chamber and an open position to permit access to the wash chamber; and a hinge rotatably connecting the lid to the top panel, the hinge defining a lid pivot axis and a hinge pivot axis offset from the lid pivot axis, whereby the lid rotates relative to the top panel about the lid pivot axis and a portion of the hinge rotates relative to the top panel about the hinge pivot axis, wherein the lid pivot axis is defined by a pin and the hinge pivot axis is defined by a cam, and wherein the cam bears against the bearing surface throughout a range of motion of the lid from the closed position to the open position.

2. The washing machine appliance of claim 1, wherein the hinge further comprises a torque transfer mechanism.

3. The washing machine appliance of claim 2, wherein the torque transfer mechanism comprises a spring.

4. The washing machine appliance of claim 2, wherein the torque transfer mechanism comprises a hydraulic damper.

5. The washing machine appliance of claim 1, wherein the hinge further comprises a torque transfer mechanism, and wherein the cam is coupled to the torque transfer mechanism.

6. A washing machine appliance, comprising:

a cabinet defining a lateral direction, a transverse direction, and a vertical direction, the lateral, transverse, and vertical directions are mutually orthogonal;

a top panel on the cabinet that defines an opening;

a stanchion mounted to the top panel, the stanchion comprising a bearing surface;

a wash chamber within the cabinet below the opening of the top panel;

a lid rotatable through a plane defined by the transverse direction and the vertical direction between a closed position to sealingly enclose the wash chamber and an open position to permit access to the wash chamber; and a hinge rotatably connecting the lid to the top panel, the hinge defining a compound pivot axis, whereby the lid rotates relative to the top panel about the compound pivot axis, wherein the compound pivot axis is defined by a pin and a cam, and wherein the cam bears against the bearing surface throughout a range of motion of the lid from the closed position to the open position.

7. The washing machine appliance of claim 6, wherein the hinge further comprises a torque transfer mechanism.

8. The washing machine appliance of claim 7, wherein the torque transfer mechanism comprises a spring.

9. The washing machine appliance of claim 7, wherein the torque transfer mechanism comprises a hydraulic damper.

10. The washing machine appliance of claim 6, wherein the hinge further comprises a torque transfer mechanism, and wherein the cam is coupled to the torque transfer mechanism.

* * * * *